US007956262B1

(12) United States Patent
Maiorana

(10) Patent No.: US 7,956,262 B1
(45) Date of Patent: Jun. 7, 2011

(54) LOCKING POST SYSTEM FOR A GUITAR BRIDGE

(76) Inventor: Christopher P. Maiorana, Grosse Pointe Farms, MI (US)

( * ) Notice: Subject to any disclaimer, the term of this patent is extended or adjusted under 35 U.S.C. 154(b) by 0 days.

(21) Appl. No.: 12/704,734

(22) Filed: Feb. 12, 2010

Related U.S. Application Data

(63) Continuation of application No. 12/361,619, filed on Jan. 29, 2009, now Pat. No. 7,663,039, which is a continuation of application No. 11/513,938, filed on Aug. 31, 2006, now abandoned, which is a continuation-in-part of application No. 11/365,368, filed on Mar. 1, 2006.

(51) Int. Cl.
*G10D 3/00* (2006.01)

(52) U.S. Cl. ..... 84/313; 84/267

(58) Field of Classification Search ..... 84/313
See application file for complete search history.

(56) References Cited

U.S. PATENT DOCUMENTS

| | | | | | |
|---|---|---|---|---|---|
| 3,956,962 | A * | 5/1976 | Fields | 84/267 |
| 4,433,605 | A * | 2/1984 | Matsui | 84/299 |
| 4,717,302 | A * | 1/1988 | Adams et al. | 411/378 |
| 4,787,285 | A * | 11/1988 | Goto | 84/313 |
| 4,796,505 | A * | 1/1989 | Takeuchi | 84/313 |
| 5,373,769 | A * | 12/1994 | Sherman | 84/313 |
| 6,201,172 | B1 * | 3/2001 | Denton | 84/313 |

* cited by examiner

*Primary Examiner* — Elvin G Enad
*Assistant Examiner* — Christopher Uhlir
(74) *Attorney, Agent, or Firm* — Christopher P. Maiorana, PC

(57) ABSTRACT

An apparatus for a guitar comprising a first compressible member, one or more spacers and a second compressible member. The second compressible member may be configured to receive the one or more spacers and engage the first compressible member when a force is applied to the first compressible member.

16 Claims, 8 Drawing Sheets

LOCKING POST SYSTEM FOR A GUITAR BRIDGE

This application is a continuation of U.S. Ser. No. 12/361,619, filed Jan. 29, 2009 now U.S. Pat. No. 7,663,039, which is a continuation of U.S. Ser. No. 11/513,938 filed Aug. 31, 2006 now abandoned, which is a continuation-in-part of U.S. Ser. No. 11/365,368 filed Mar. 1, 2006.

FIELD OF THE INVENTION

The present invention relates to locking bridges on guitars generally and, more particularly, to a method and/or apparatus for securing the posts in a locking bridge system that does not have a pre-installed set screw.

BACKGROUND OF THE INVENTION

Electric guitars are often equipped with a moveable bridge, sometimes referred to as a tremolo or a whammy bar. Conventional tremolo systems, such as the tremolo used on the Fender Stratocaster guitar sold under the trademark STRATOCASTER™, have conventional tuners, and a conventional nut. Refinements to the conventional tremolo have been made, such as with the Floyd Rose locking system sold under the trademark FLOYD ROSE™. With such a system, the strings use conventional tuners for rough tuning, then the strings lock at the nut. Such a system prevents movement and binding of the strings within the nut. Fine tuners are provided to allow further tuning after the nut has been locked.

In either conventional tremolo system, the posts (also known as studs) that hold the tremolo in place are threaded into anchors that are embedded in the body of the guitar. The anchor makes a physical connection with the wood of the guitar body and has inner threads that allow the height of the posts to be adjusted with the anchors. Adjusting the height of the posts changes the height of the tremolo from the guitar body, which in turn changes the action of the guitar. However, the movement of the posts within the tolerances of the threads can cause the overall tuning of the guitar to be less than desirable. Additionally, movement of the posts back and forth within the tolerances of the threads can cause the anchor, over time, to form an elongated hole within the wood of the guitar. In severe cases, the elongation may be so drastic that the anchor may pull out of the wood with little or no force at all, initiating a trip to a guitar repair shop.

One conventional system used to securely hold the posts and the anchors is to install a small set screw through the middle of the post. The set screw makes contact with the bottom of the anchor to secure the threads of the post to the threads of the anchor. However, not all guitar anchors have a bottom portion that a set screw can connect with. In such a system, there is nothing for the set screw to hold against, other than the wood of the guitar. Having a set screw touch the wood of the guitar does not ensure a snug fit and may damage the wood of the guitar body. Furthermore, posts containing set screws are expensive, may be difficult to locate and may not be available for every type of thread.

One solution to create a secure fit when using bottomless anchors is to first use a flat piece of metal or hard plastic with a thread that can be adjusted with a screwdriver. Such a piece is placed into the anchor first. After making a rough adjustment, the post is secured inside the anchor creating a snug fit. However, such a system has limited flexibility in adjusting the height of the post after the initial installation. Such a lack of adjustment makes the initial setup of a guitar tedious. Also, since guitars are normally adjusted on a periodic basis, the lack of fine tuning of the height of the post is a disadvantage. Another approach would be to simply remove the existing anchor, and replace it with a new anchor and a post with a set screw. However, such a modification requires expertise in removing the old anchor without damaging the finish of the guitar.

It would be desirable to retrofit an existing anchor and post system with a device that would allow securing the post to the anchor, yet still provide fine height adjustments through varying the height of the post.

SUMMARY OF THE INVENTION

The present invention concerns an apparatus for a guitar comprising a first compressible member, one or more spacers and a second compressible member. The second compressible member may be configured to receive the one or more spacers and engage the first compressible member when a force is applied to the first compressible member.

The objects, features and advantages of the present invention include providing an apparatus and/or method for securing a post into an anchor of a guitar tremolo that may (i) reduce the loosening of an anchor within a guitar, (ii) reduce the frequency with which the anchor must be replaced, (iii) create a more secure connection between a pre-existing post and anchor without having to replace either part, (iv) allow for easy tremolo height adjustment and/or (v) avoid over tightening of the post and/or driving the post into the guitar body.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
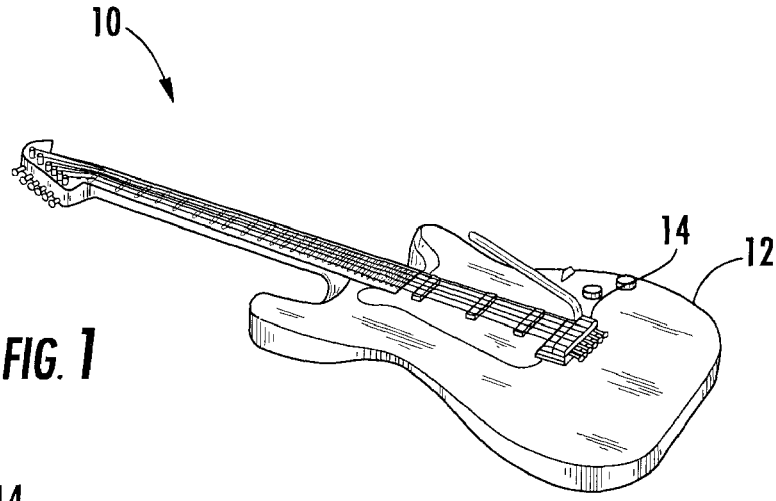
FIG. 1 is a perspective view of an electric guitar.

Referring to FIG. 1, a guitar 10 is shown in the context of the present invention. The guitar 10 generally comprises a guitar body 12 that may serve as the point of attachment for a tremolo 14.

Figure 2:
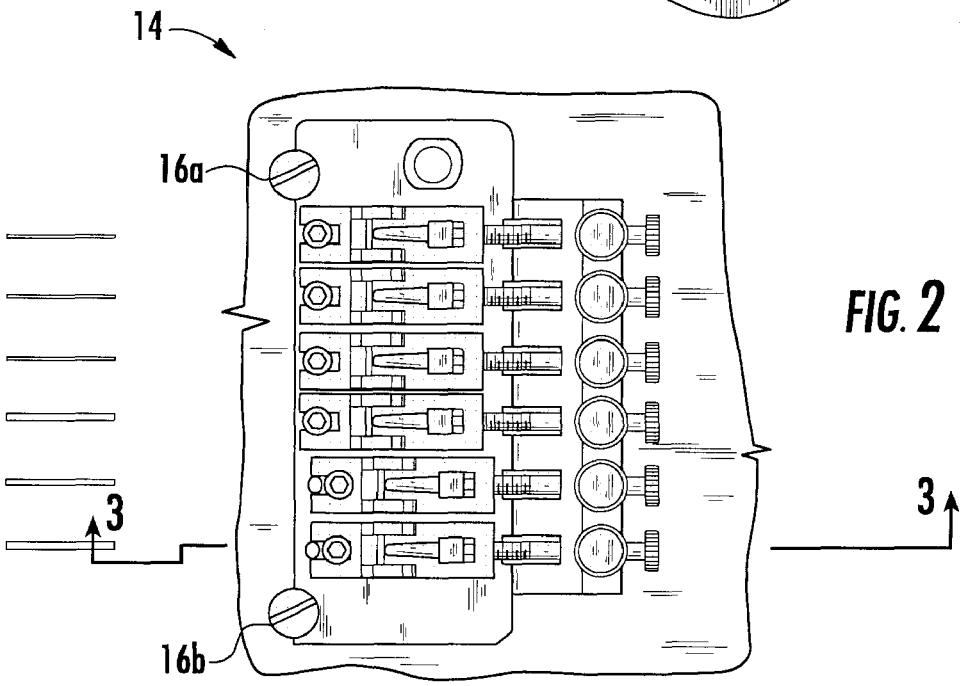
FIG. 2 is a top view of a tremolo.
Figure 3:
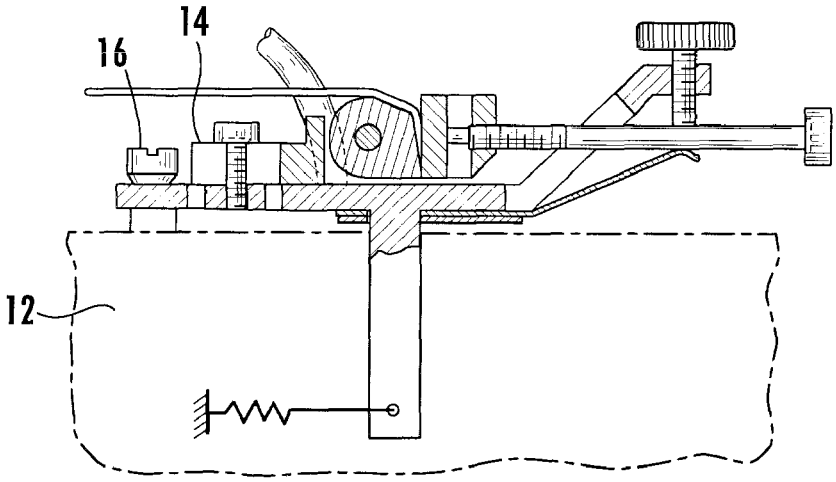
FIG. 3 is a side view of a tremolo.

Referring to FIGS. 2 and 3, more details of the tremolo 14 are shown. The tremolo 14 is held in place against the body 12 by two or more posts 16*a*-16*b*. The posts 16*a*-16*b* generally comprise a threaded metal or plastic screw. The posts 16 are threaded into anchors (not shown) that are embedded in the guitar body 12.

Figure 4:
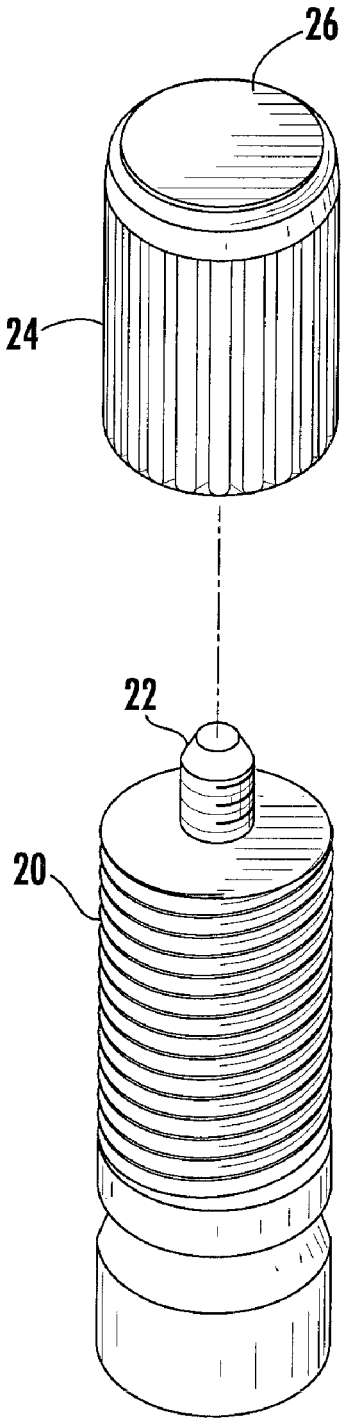
FIG. 4 is a perspective view of a post with a set screw and a perspective view of a "closed" anchor.

Referring to FIG. 4, a post 20 is shown that contains a set screw 22. The post 20 with the set screw 22 is generally threaded into a close-bottomed anchor 24. An open end (not shown) of the close-bottomed anchor 24 may receive the post 20. A closed end 26 may be embedded within the guitar body 12. The post 20 is threaded into the anchor 24 and tightened in place using a screw driver or allen key. The set screw 22 is also then tightened, using a screw driver or alien key. The set screw 22 may be tightened against the closed end 26 of the anchor. Care needs to be taken to avoid over tightening the set screw 22. If the set screw 22 is over tightened, the set screw 22 may protrude through the closed end 26 and make contact with the guitar body 12, which is undesirable. The set screw 22 may further secure the post 20 into the anchor 24 and reduce the lateral movement of the post 20 within the anchor 24.

Figure 5:
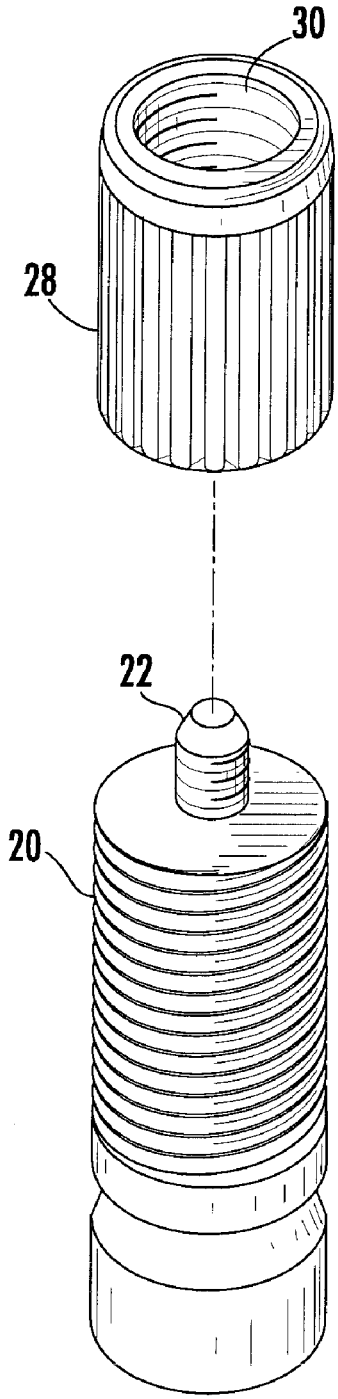
FIG. 5 is a perspective view of a post with a set screw and an "open" anchor.

Referring to FIG. 5, an open-bottom anchor 28 is shown. The open-bottomed anchor 28 may be used with the post 20. A first open end (not shown) of the anchor 28 may receive the post 20. A second open end 30 may be in contact with the guitar body 12. The post 20 is threaded into the anchor 28 using a screw driver or alien key. The set screw 22 is then also tightened using a screw driver or allen key. However, since the anchor 28 does not have a closed end, the set screw 22, when tightened, passes through the opening 30 of the anchor 28 and bores into the wood of the guitar body 12. The boring of the set screw 22 in the guitar body 12 often does not secure the post 20 into the anchor 28 and sometimes causes physical damage to the guitar body 12. The post 20 with the set screw 22 is expensive to purchase, difficult to locate and ineffective when used in conjunction with an open-bottomed anchor 28. Furthermore, replacing an open-bottomed anchor 28 with a closed-bottomed anchor 24 requires expertise and care not to damage the finish of the guitar body since the open-bottomed anchor 28 is embedded within the guitar body 12.

Figure 6:
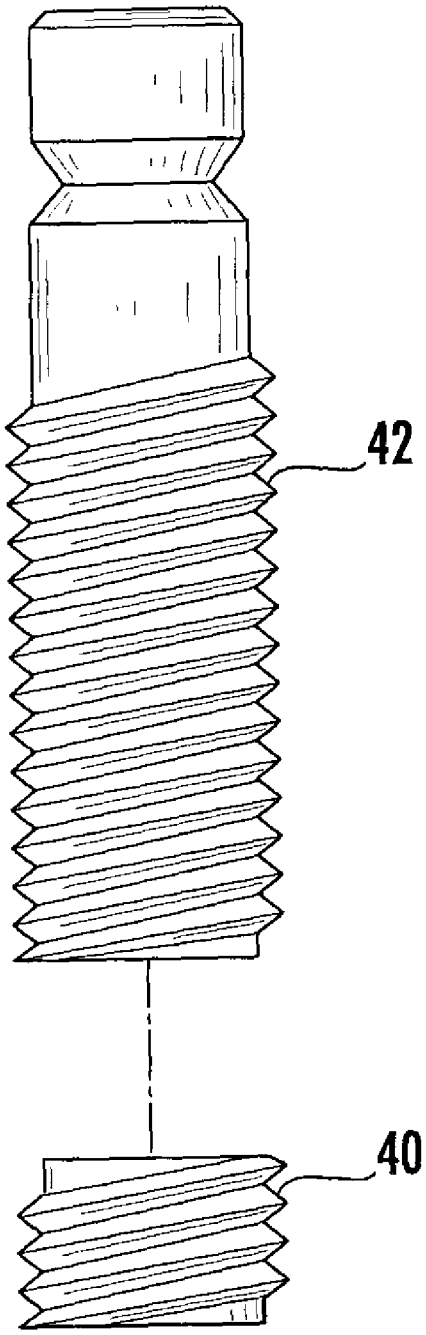
FIG. 6 is a side view of a post with additional flat metal piece.

Referring to FIG. 6, an alternative to using the post 20 with the set screw 22 having a lower post portion 40 and an upper post portion 42 is shown. The lower post portion 40 and the upper post portion 42 may be purchased as a set from a guitar shop. The lower post portion 40 and the upper post 42 may be used in conjunction with the open-bottomed anchor 28. First, the lower post portion 40 is threaded into the anchor 28 and secured at a particular height within the anchor 28 to the specification of the musician. The upper post portion 42 is then threaded into the anchor 28 and tightened to make contact with the lower post portion 40. Once the upper post portion 42 is tightened, further height adjustment cannot be made without taking out the upper post portion. A disadvantage with using the lower post portion 40 and the upper post portion 42 is that such a configuration does not allow for easy adjustment of the height of the lower post portion 40 and the overall height of the tremolo 14. In order for the height of the lower post portion 40 to be adjusted, the upper post portion 42 must first be completely loosened and removed from the anchor 28. The height of the lower post portion 40 is then adjusted to the desired height. Then the upper post portion 42 is rethreaded and tightened against the lower post portion 40. Such a process may have to be repeated a number of times until the desired height of the tremolo 14 is obtained. Therefore, adjusting the height of the tremolo 14 when using the lower post portion 40 and the upper post portion may be very inconvenient and time consuming.

Figure 7:
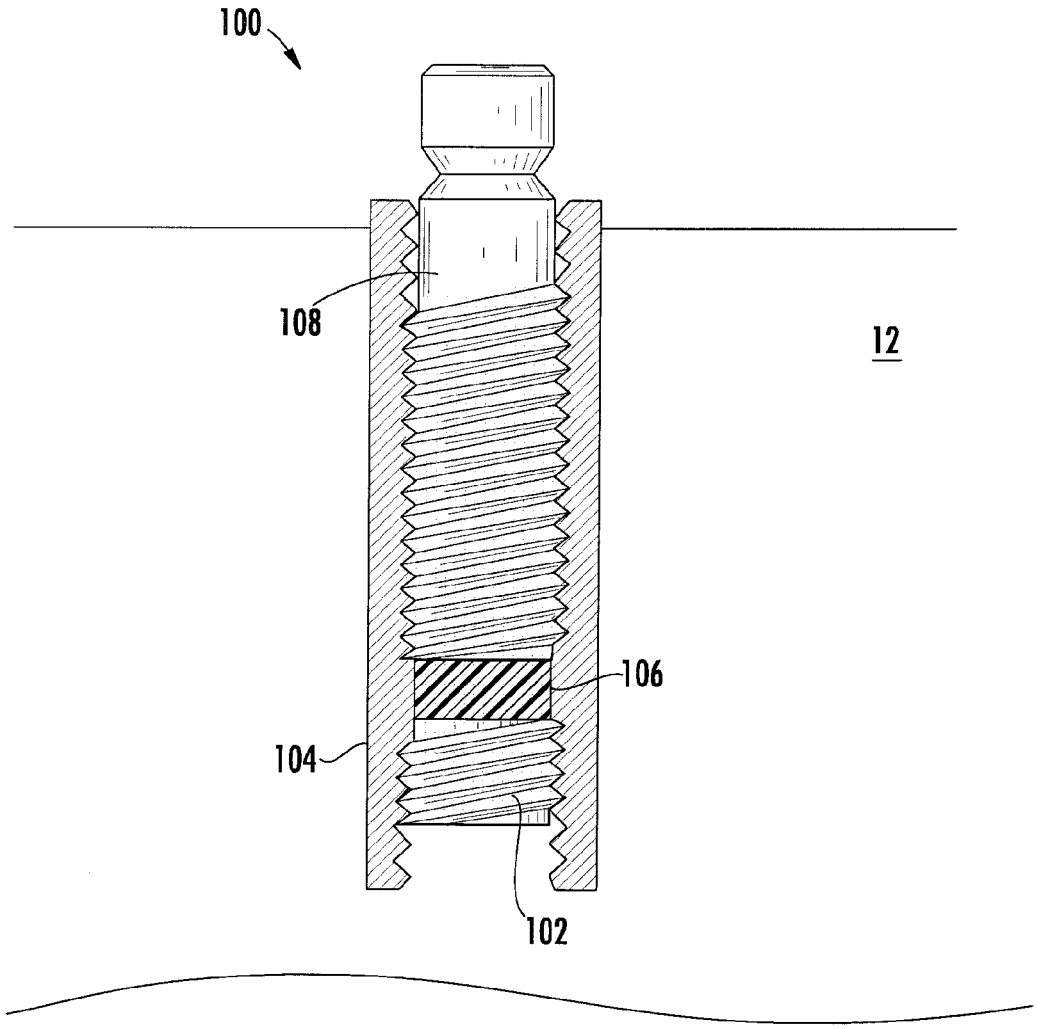
FIG. 7 is a side view of a post, an anchor and a spacer.

Referring to FIG. 7, another system 100 is shown. The system 100 comprises a lower post portion 102 that is threaded into an anchor 104. An upper post portion 108 is secured at a particular height within the anchor 104. The length of the upper post portion 108 may be longer than the length of the lower post portion. The length of the upper post portion 108 and the lower post portion 102 may be varied to meet the design criteria of a particular implementation. A flat piece of compressible material 106 is placed into the anchor 104. The compressible material 106 may be cylindrical in shape. The diameter of the compressible material 106 may be smaller than the diameter of the upper post portion 108 and the lower post portion 102. However, the diameter of the compressible material 106 may be varied to meet the design criteria of a particular implementation.

The compressible material 106 may be positioned below the upper post portion 108 and above the lower post portion 102. The compressible material 106 may be composed of any of a plurality of materials, including but not limited to hard styrofoam, kevlar or hard rubber. The particular type of material used may be varied to meet the design criteria of a particular implementation. The upper post portion 108 may be threaded and secured above the compressible material 106. The compressible material 106 may be compressible enough to accommodate the tightening of the threads of upper post portion 108 by one to two turns. The compressible material 106 may resist compression sufficiently to ensure that the guitar strings do not become loose. The compressible material 106 may cause the threads of the upper portion 108 and the threads of the lower portion 102 to lock into the threads of the anchor 104. The compressible material 106 may maintain the lock, but still permit the adjustment of the upper post portion 108 (and therefore the height of the tremolo 14) without removing the upper post portion 108 and/or having to readjust the position of the lower post portion 102. Therefore, the compressible material 108 makes adjusting the tremolo height 14 easy and much less time consuming than conventional approaches.

The anchor 104 includes an open end below the lower post portion 102. However, the anchor 104 may be also implemented with a closed end (not shown). A gap may be formed between the lower post portion 102 and the closed end. The height of the gap between the lower post portion 102 and the closed end of the anchor 104 may be defined by the position of the lower post portion 102 in the anchor 104.

Rather than purchasing the lower post portion 102 and the upper post portion 108, the lower post portion 102 and the upper post portion 108 may be constructed from the post 16. In a first step, the bottom portion of the post 16 may be chopped off to create two pieces. A first piece may be used as the lower post portion 102. A second piece may be used as the upper post portion 108. In one example, the post 16 may be held in a vice while the bottom portion of the post 16 is chopped off using a saw, utility knife, or other similar tool. The post 16 may be cut so that the lower post portion 102 (i) is long enough to retain enough threads to properly thread into the anchor 104, (ii) remains in the same position when pressure is applied from the compressible material 106, and (iii) does not break when pressure is applied from the upper post portion 108. In a second step, a slot or groove is created in the top surface of the lower post portion 102 to receive the head of a screw driver or an allen key. In a third step, the lower post portion 102 is threaded into the anchor 104 using the screwdriver or allen key and left at the desired height within the anchor 104. In a fourth step, the compressible material 106 is placed above the lower post portion 102. In a fifth step, the upper post portion 108 is threaded into the anchor 104 and tightened until the desired height of the tremolo 14 is obtained.

Figure 8:
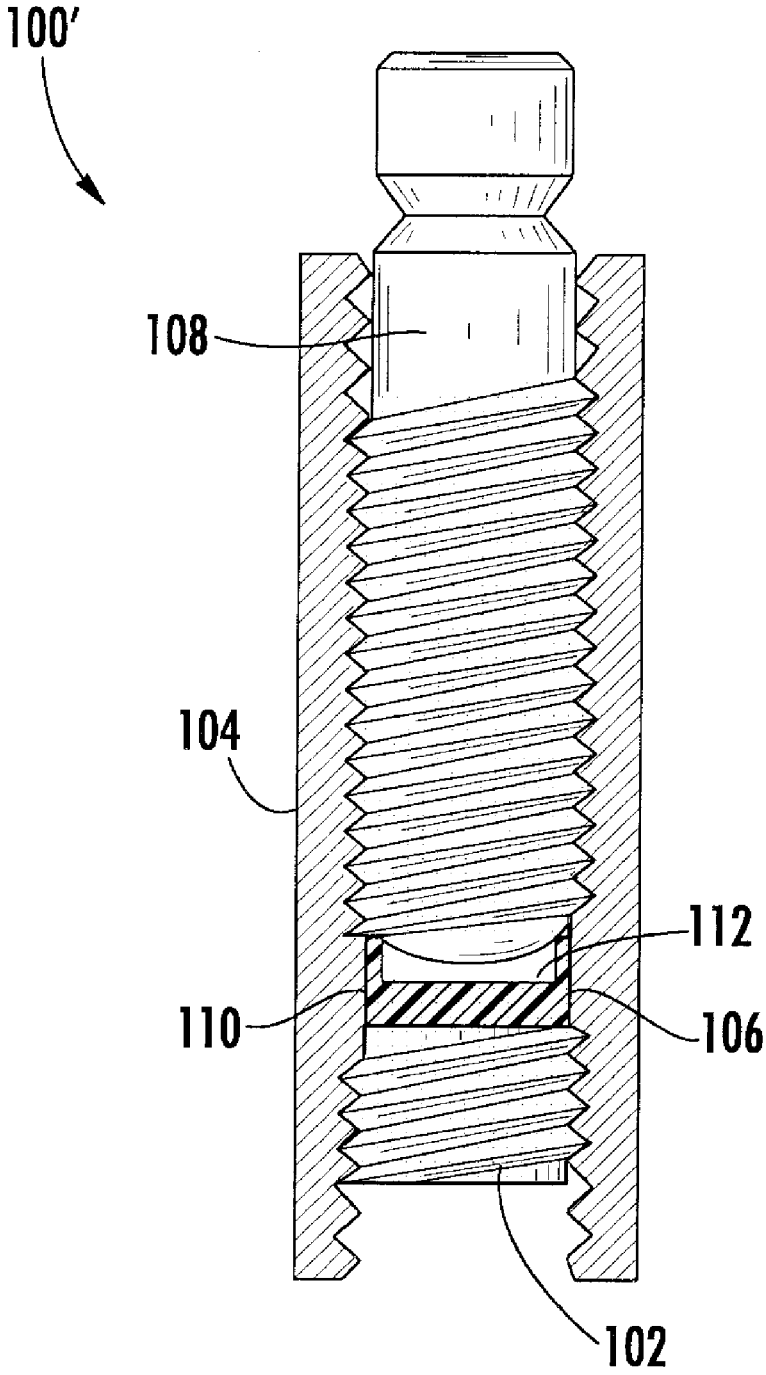
FIG. 8 is a side view of a post, an anchor and alternative spacer.

FIG. 8 illustrates an alternative system 100' of the present invention where the piece of compressible material 112 is not flat. An outer ridge 110 of the compressible material 106 may be taller than the center area of the compressible material 106. Further, a bottom edge 112 of the upper post portion 108 may be rounded using a file, sander or other similar tool. The center area of the compressible material 106 may receive the round bottom edge 112 of the upper post portion 108. The outer ridge 110 of the compressible material 106 may surround the bottom edge 112 of the upper post portion 106. The combination of the outer ridge 110 of the compressible material 106 with the bottom edge 112 of the upper post portion 108 may create a tighter fit between the upper post portion 108 and the compressible material 106. Therefore, the movement of the upper post portion 108 in the anchor 104 may be reduced.

In one example, the compressible material 106 may be shaped in the form of a pyramid. The interior of the pyramid may be hollow. As the upper post portion 108 is screwed in the anchor 104, the top portion of the pyramid may compress in a downward direction. The pyramid shaped compressible material 106 may be implemented to allow the upper post portion 108 to be rotated one to two turns. In particular, the compression of the pyramid shaped compressible material 106 may be implemented to allow the upper post portion 108 to be rotated one to two turns, while still maintaining a snug lock between the threads.

In one example, the compressible material 106 may be shaped into a sphere (or ball). The implementation of the sphere shaped compressible material may allow a user to easily insert the compressible material 106 into the anchor 104. The sphere shaped compressible material 106 may be configured to allow the upper post portion 108 to be rotated one to two turns. The particular shape of the compressible material may be varied to meet the design criteria of a particular implementation.

Figure 9:
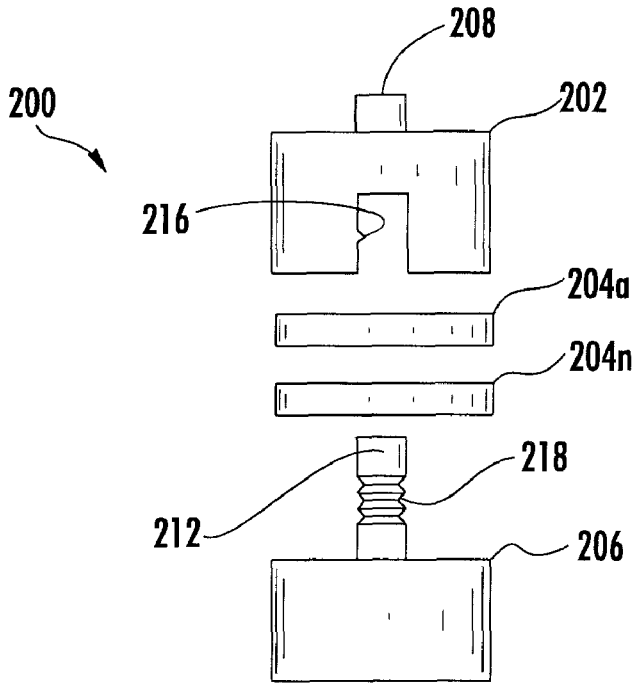
FIG. 9 is an exploded view of a compressible member assembly.

Referring to FIG. 9, an exploded view of a compressible member assembly 200 is shown. The compressible member assembly 200 generally comprises a first compressible member 202 and a second compressible member 206. The first compressible member 202 may be cylindrical in shape. The first compressible member 202 normally includes a first post 208. The first post 202 may be integrated (or integral) with the first compressible member 202. The first compressible member 202 may define a channel. The channel may be positioned opposite the first post 208. A locking tab 216 may be positioned within the channel of the first compressible member 202.

The second compressible member 206 may be cylindrical in shape. The particular shape of the first compressible member 202 and the second compressible member 206 may be varied to meet the design criteria of a particular implementation. The second compressible member 206 includes a second post 212. The second post 212 may be integrated (or integral) with the second compressible member 206. The second post 212 includes a plurality of recesses 218.

The compressible member assembly 200 generally comprises one or more spacers 204*a*-204*n*. The number of spacers 204*a*-204*n* used in the compressible member assembly 200 may be varied to meet the design criteria of a particular implementation. Each spacer 204*a*-204*n* may include an opening (not shown). The height (or thickness) of each spacer 204*a*-204*n* may be less than the height of the first compressible member 202 and the second compressible member 206. In one example, the thickness of each of the spacers 204*a*-204*n* may be equal to each other. In one example, the thickness of each of the spacers 204*a*-204*n* may be different from one another. The particular height and/or thickness of each of the spacers 204*a*-204*n* may be varied to meet the design criteria of a particular implementation.

Figure 10:
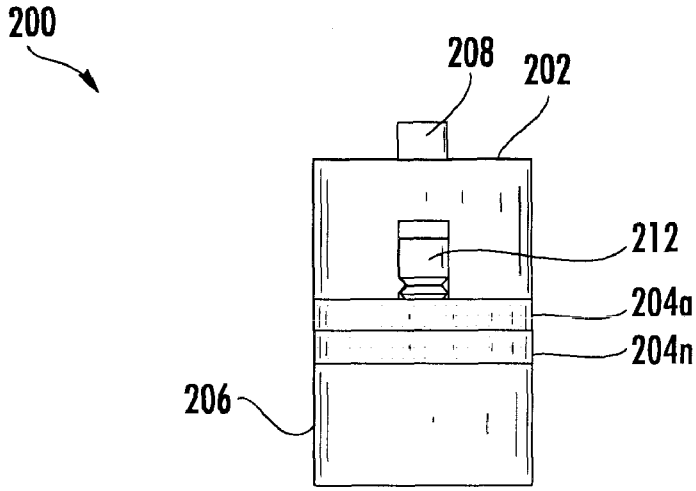
FIG. 10 is a side view of the compressible member assembly.

Referring to FIG. 10, a side view of the compressible member assembly 200 is shown. The second post 212 may be inserted through the openings of the spacers 204*a*-204*n*. The spacers 204*a*-204*n* may provide for the fine adjustment of the height of the tremolo to the guitar body 12. In one example, the second post 212 may be configured to receive additional spacers to finely adjust and increase the height of the compressible member assembly 200. In one example, the second post 212 may be configured to receive a single spacer or even no spacers at all in order to finely adjust and decrease the overall height of the compressible member assembly 200. The channel of the first compressible member 202 may be configured to receive the second post 212. The channel of the first compressible member 202 may provide a tight fit over the second post 212. The locking tab 216 of the first compressible member 202 may lock into any one of the particular recesses 218 to ensure that the first compressible member 202 is positively locked to the second compressible member 206. The plurality of recesses 218 may be positioned around the entire circumference of the second post 212. Such a positioning of the recesses 218 will ensure that it is not necessary to position the first compressible member 202 in a particular orientation with respect to the second compressible member 206 to lock the locking tab 216 into any one of the particular recesses 218. In general, the assembly 200 may be installed and/or removed from an anchor of a guitar as a complete system.

Figure 11:
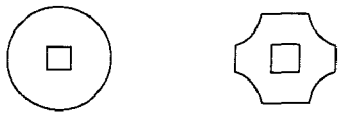
FIG. 11 is a top view of a spacer and an alternate embodiment of the spacer.

FIG. 11 illustrates different embodiments of the spacers 204*a*-204*n*. In one example, the spacer may be cylindrical. In one example, portions of the spacer may be removed while still maintaining a generally cylindrical shape. With the removal of pre-selected portions from the spacer, the spacer may allow for greater compression between the first compressible member 202 and the second compressible member 206. The shape of the spacer may be varied to meet the design criteria of a particular implementation. The spacer may have a diameter which is less than the diameter of the anchor 104. The diameter of the spacer may be varied to meet the design criteria of a particular implementation.

Figure 12:
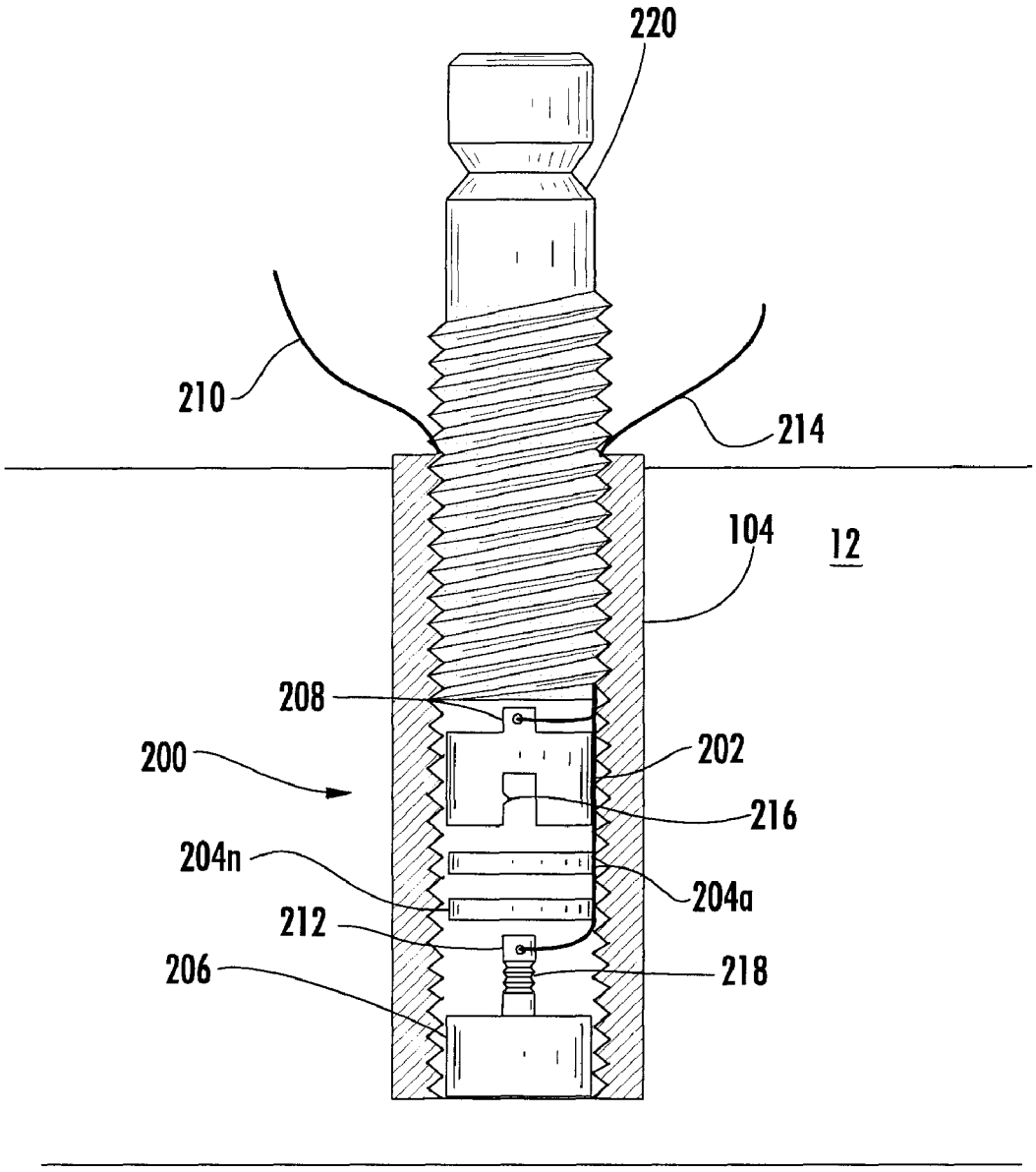
FIG. 12 is an exploded view of a post and the compressible member assembly positioned in the anchor of a guitar body.

Referring to FIG. 12, a view of the compressible member assembly 200 positioned in the anchor 104 of a guitar body 12 is shown. The compressible member assembly 200 may be installed in the anchor 104 without the need to modify the anchor 104. A post 220 may be positioned above the compressible member assembly 200. The compressible member assembly 200 may be configured to provide tension between the post 220 and the anchor 104 of the guitar body 12. The tension may be applied between the threads of the anchor 104 and the threads of the post 220. In one example, the post 220 may have an overall height which is equivalent to the height of the upper post 108 and the lower post 102 as shown in connection with FIG. 7. The particular height of the post 220 may be varied to meet the design criteria of a particular implementation. The compressible member assembly 200 may be removed from the anchor 104 of the guitar tremolo. The compressible member assembly 200 may be installed and removed in and out of the anchor 104 without damaging the anchor 104. To insert the compressible member assembly 200 into the anchor 104, a user may perform the following steps.

In a first step, the user may place a predetermined number of spacers 204*a*-204*n* over the second post 212 of the second compressible member 206. The user may select the number of spacers 204*a*-204*n* based on the desired height of the tremolo. The addition and removal of spacers 204*a*-204*n* to and from the second post 212 may provide for the fine adjustment of the tremolo in relation to the guitar body 12. If a greater height adjustment is needed, multiple compressible member assemblies 200 may be added to provide for a coarse (or large) adjustment of the height for the tremolo with respect to the guitar body 12. In a second step, the user may drop the compressible member assembly 200 (with the spacers 204*a*-204*n* positioned around the second post 212 and the first compressible member 202 with the second compressible member 206) into the anchor 104.

In a third step, the user may insert the post 220 into the anchor 104 and tighten the post 220 such that a bottom portion of the post 220 engages the first post 208. In one example, the first post 208 may have an opening to receive a string 210. The second post 212 may have an opening to receive a string 214. The compressible member assembly 200 may be removed from the anchor 104 of the tremolo. The string 210 may be used to facilitate the removal of the first compressible member 202 from the anchor 104 prior to tightening the post 220. The string 214 may be used to facilitate the removal of the second compressible member (along with the spacers 204*a*-204*n*) from the anchor 104 prior to tightening the post 220. Once a user has determined that the compressible member assembly 200 provides the sufficient amount of height for the tremolo with respect to the guitar body 12, the user may remove the compressible member assembly 200 from the anchor 104 (by pulling the string 214). The user may then remove the strings 210 and 214 (e.g., by cutting the strings 210 and 214) prior to tightening the post 220. The user may then reinsert the compressible member assembly 200 into the anchor 104.

If the strings 210 and 214 are not included in the compressible member assembly 200, the user may simply turn over the guitar body 12 in order to remove the compressible member assembly 200 from the anchor 104. The diameter of the compressible member assembly 220 may be smaller than the overall diameter of the anchor 104 in order to facilitate the easy removal of the compressible member assembly 200 from the anchor 104.

Figure 13:
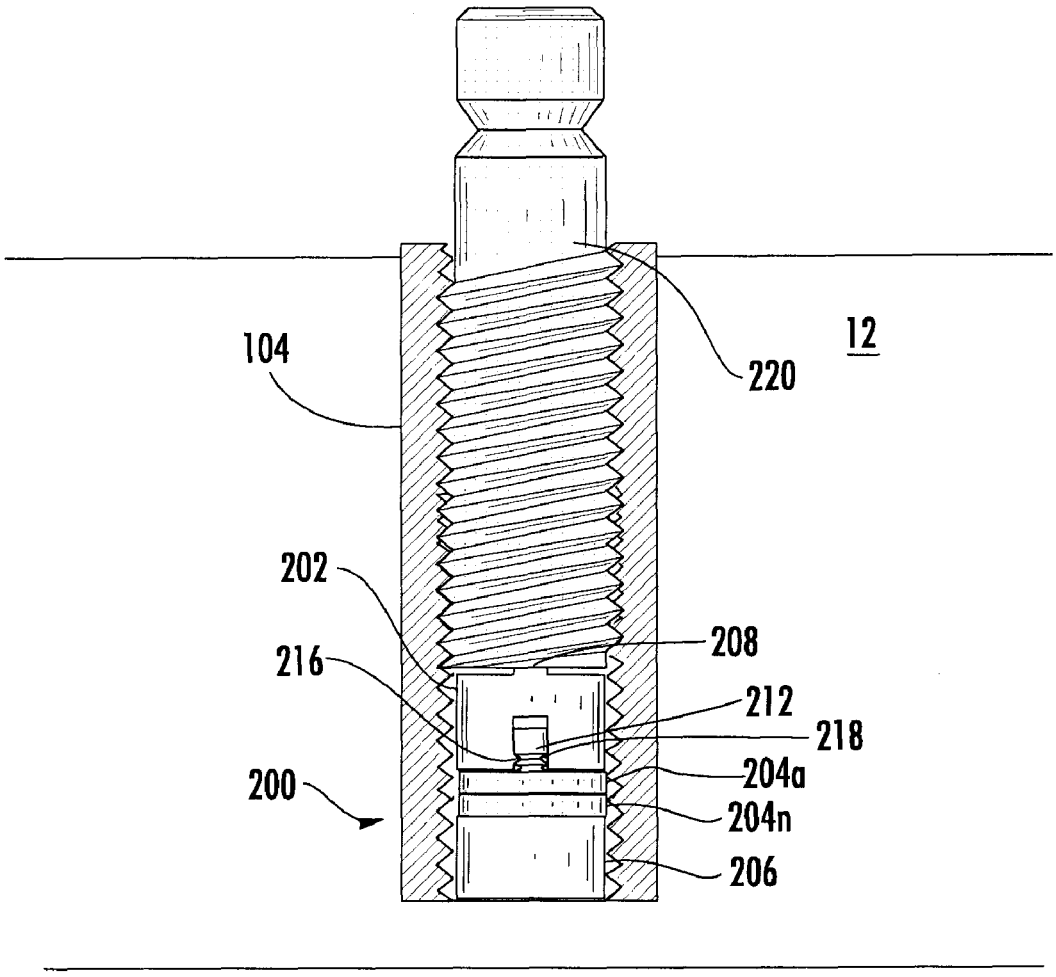
FIG. 13 is a side view of the post and the compressible member assembly positioned in the anchor of the guitar body.

Referring to FIG. 13, a side view of the post 220 and the compressible member assembly 200 in a compressed state is shown. The user may tighten the post 220 such that the post 220 applies a downward force on the first compressible member 202. The spacers 204*a*-204*n* may be sandwiched between the first compressible member 202 and the second compressible member 206. Prior to applying force to the first compressible member 202 with the post 220, the spacers 104*a*-104*n* may be compressible enough to accommodate additional tightening of the threads of the post 220 by one to two turns. Once the threads of the post 220 have been tightened by one to two turns, the spacers 204*a*-204*n* may become rigid and resist compression sufficiently to ensure that the guitar strings do not become loose. The locking tab 216 may be locked against any one of the particular recesses 218 to positively lock the second compressible member 206 to the first compressible member 202.

In general, the locking tab 218 may be configured to move to a lower recess on the second post 212 as the post 220 applies a downward force on the first compressible member 202. Once the threads of the post 220 have been tightened by one to two turns, the spacers 204*a*-204*n* may be in a rigid state and prevent further compression. In such a state, the locking tab 216 may be locked into a corresponding recess 218 to positively lock the second compressible member 206 to the first compressible member 202. The channel of the first compressible member 202 may be sized appropriately to ensure that a tight fit is established with the second post 214 of the second compressible member 206. A gap may be provided between the top of the second post 212 and a top section of the channel. The gap may allow the second post 212 to travel higher into the channel as the compressible member assembly compress. In general, the compressible member assembly 200 may cause the threads of the post 220 to firmly lock into the threads of the anchor 104. The spacers 204*a*-204*n* may provide for the fine adjustment of the height of the tremolo.

If the user determines that a fine adjustment is needed to increase the overall height of the tremolo in relation to the guitar body 12, the user may add additional spacers 204*a*-204*n* to the second compressible member 206. The user may simply (i) remove the post 220 and (ii) add additional spacers 204*a*-204*n* over the second post 212 to achieve the desired height of the tremolo. Prior to adding additional spacers 204*a*-204*n*, the user may separate the first compressible member 202 from the second compressible member 206. The locking tab 216 may be easily disengaged from any one of the particular recesses 218 when the user separates the first compressible member 202 from the second compressible member 206. The user may then reinsert the compressible member assembly 200 with the additional spacers 204*a*-204*n* into the anchor 104.

If the user determines that a fine adjustment is needed to decrease the overall height of the tremolo in relation to the guitar body 12, the user may remove any of the spacers 204*a*-204*n* from the second compressible member 206. The user may then (i) remove the post 220 and (ii) remove the desired number of spacers 204*a*-204*n* needed to achieve the desired height of the tremolo.

The compressible member assembly 200 may be implemented with the anchor 104 that includes the upper post 108 and the lower post 102 as shown in connection with FIG. 7. The compressible member assembly 200 may be inserted between the upper post 108 and the lower post 102. With such a configuration, if it is necessary to finely adjust the height of the tremolo to a higher position, additional spacers 204*a*-204*n* may be added to the compressible member assembly 200. With the compressible member assembly 200, it is not necessary to adjust the lower post 102 to a higher position within the anchor 104 to increase the height of the tremolo to a higher position. A user may add additional spacers 204*a*-204*n* to the second compressible member 206. If it is necessary to finely adjust the height of the tremolo to a lower position, spacers 204*a*-204*n* may be removed from the compressible member assembly 200. With the compressible member assembly 200, it is not necessary to adjust the lower post 102 to a lower position within the anchor 104 to reduce the height of the tremolo to a lower position.

The compressible member assembly 200 may provide enough compression to accommodate finely adjusting the height of the upper post 108 by one to two turns. If it is necessary to provide for a greater adjustment (or a coarse adjustment) of the height of the tremolo, multiple compressible member assemblies 200 may be added to the anchor 104. The overall height of the upper post 104 may be increased or decreased without removing the lower post 102 from the tremolo 104. By adjusting the overall height (via a fine adjustment or coarse adjustment) of the upper post 108, the height of the tremolo with respect to the guitar body 12 may be increased or decreased.

The compressible member assembly 200 may easily facilitate interchanging tremolos designed for a particular brand of guitar to be inserted into another brand of guitar. The compressible member assembly 200 may allow for tremolos used in guitars having small bodies to be inserted into guitars having larger bodies (e.g., guitar bodies that may need longer posts in order to couple tremolos into longer anchors). In such a case, the compressible member assembly 200 may compensate for a short post of a tremolo when inserted into a larger anchor.

The compressible member assembly 200 may be sold and distributed in individual bags. In one example, each bag may include up to two compressible member assemblies. Each compressible member assembly 200 may include up to six spacers. The compressible member assembly 200 may be made of hard styrofoam, kevlar and hard rubber. The first compressible member 202, the spacers 204*a*-204*n* and the second compressible member 206 may each be made from a different material (e.g., hard styrofoam, kevlar and hard rubber) from one another in order to achieve desired compression characteristics.

While the invention has been particularly shown and described with reference to the preferred embodiments thereof, it will be understood by those skilled in the art that various changes in form and details may be made without departing from the spirit and scope of the invention.

The invention claimed is:

1. An apparatus for a guitar comprising:

a first member;

one or more compressible spacers; and a second member configured to receive said one or more compressible spacers and engage said first member when a downward force is applied to said first member, wherein (i) said apparatus provides tension between a first set of threads of a post and a second set of threads of an anchor of a guitar tremolo, (ii) said post is turned within said anchor to create said downward force, (iii) said anchor is configured to be embedded in a body of said guitar, (iv) said first member defines a channel therein to receive said second member, (v) said second member includes a second post having a plurality of recesses and said channel receives said second post and provides a tight fit over said second post, (vi) said first member is configured to engage any one of said plurality of recesses and (vii) said compressible spacers are located between said first member and said second member.

2. The apparatus according to claim 1, wherein said apparatus is configured to be removable from said anchor of said guitar tremolo.

3. The apparatus according to claim 1, wherein said apparatus is configured to be installed and removed in and out of said anchor without damaging said anchor.

4. The apparatus according to claim 1, wherein said apparatus is configured to be installed in said anchor without the need to modify said anchor.

5. The apparatus according to claim 1, wherein a length of any one of said spacers is less than a length of said first member and said second member.

6. The apparatus according to claim 1, wherein said apparatus provides a fine adjustment of a height of a tremolo with respect to a guitar body based on said one or more spacers.

7. The apparatus according to claim 1, wherein multiple apparatus are used to provide a coarse adjustment of a height of a tremolo with respect to a guitar body.

8. The apparatus according to claim 1, wherein each of said first member, said one or more spacers and said second member are made from a group consisting of hard styrofoam, kevlar and hard rubber or any combination therein.

9. The apparatus according to claim 1, wherein said first member, said second member and said one or more spacers are cylindrical.

10. The apparatus according to claim 1, wherein said one or more spacers comprises two or more spacers having the same thickness.

11. The apparatus according to claim 1, wherein said one or more spacers comprises two or more spacers having a different thickness from each other.

12. The apparatus according to claim 1, wherein said tension operates in a direction opposite to said downward force in order to lock said first set of threads of said post into said second set of threads of said anchor.

13. The apparatus according to claim 1, wherein said downward force is created when said first set of threads of said post is tightened.

14. The apparatus according to claim 1, wherein said one or more compressible spacers have a predetermined height.

15. The apparatus according to claim 1, wherein said one or more compressible spacers have a diameter defining an opening configured to surround said first or second post.

16. The apparatus according to claim 1, wherein said apparatus comprises a plurality of compressible spacers.

* * * * *